US009463479B2

(12) United States Patent
Park et al.

(10) Patent No.: US 9,463,479 B2
(45) Date of Patent: Oct. 11, 2016

(54) PHOSPHOR DISPENSER

(71) Applicant: Samsung Electronics Co., Ltd., Gyeonggi-do (KR)

(72) Inventors: Hun-yong Park, Seoul (KR); Ho-moon Lee, Seoul (KR); Choo-ho Kim, Gyeonggi-do (KR)

(73) Assignee: SAMSUNG ELECTRONICS CO., LTD., Yeongtong-gu, Suwon-si, Gyeonggi-do (KR)

( * ) Notice: Subject to any disclaimer, the term of this patent is extended or adjusted under 35 U.S.C. 154(b) by 584 days.

(21) Appl. No.: 13/718,706

(22) Filed: Dec. 18, 2012

(65) Prior Publication Data

US 2013/0175369 A1 Jul. 11, 2013

(30) Foreign Application Priority Data

Jan. 9, 2012 (KR) ..... 10-2012-0002467

(51) Int. Cl.
*B05B 1/30* (2006.01)

(52) U.S. Cl.
CPC ..... *B05B 1/304* (2013.01); *B05B 1/3046* (2013.01)

(58) Field of Classification Search
CPC ..... B05B 1/304; B05B 1/3046
USPC ..... 239/569–586
See application file for complete search history.

(56) References Cited

U.S. PATENT DOCUMENTS

| | | | | |
|---|---|---|---|---|
| 4,101,076 | A | 7/1978 | Bart | |
| 6,508,416 | B1 | 1/2003 | Mastro et al. | |
| 6,752,332 | B1 * | 6/2004 | Terakado | F02M 51/0667 239/533.11 |
| 7,455,244 | B2 | 11/2008 | Boecking | |
| 2009/0302136 | A1 | 12/2009 | Song | |
| 2010/0287845 | A1 * | 11/2010 | Montross et al. | 51/307 |
| 2011/0045124 | A1 * | 2/2011 | Zuraw | 425/568 |

FOREIGN PATENT DOCUMENTS

| | | | |
|---|---|---|---|
| EP | 1033414 | A2 * | 9/2000 |
| EP | 1414080 | B1 | 2/2007 |

(Continued)

OTHER PUBLICATIONS

Korean Office Action issued in Korean Patent Application No. KR 10-2012-0002467 dated Jan. 14, 2013.

(Continued)

*Primary Examiner* — Arthur O Hall
*Assistant Examiner* — Viet Le
(74) *Attorney, Agent, or Firm* — Muir Patent Law, PLLC

(57) ABSTRACT

A phosphor dispenser includes: a nozzle having a space for accommodating the phosphor liquid, wherein an opening for ejecting the phosphor liquid is connected to the space; and a tappet reciprocally movable with respect to the nozzle to eject the phosphor liquid in the space through the nozzle, wherein the tappet includes a cylindrical unit having a cylindrical shape and a convex unit having a hemispherical shape that is convex towards the nozzle from the cylindrical unit, and the convex unit is formed of polycrystalline diamond (PCD).

20 Claims, 5 Drawing Sheets

(56) References Cited

FOREIGN PATENT DOCUMENTS

| | | | |
|---|---|---|---|
| JP | 2001-140608 | | 5/2001 |
| JP | 2002-361151 | | 12/2002 |
| JP | 2005-262018 | | 9/2005 |
| KR | 1999-0058654 | | 7/1999 |
| KR | 10-2002-0031553 | A | 5/2002 |
| KR | 10-2005-0057809 | | 6/2005 |
| KR | 10-2005-0076265 | A | 7/2005 |
| KR | 10-2009-0107082 | | 10/2009 |
| KR | 10-1006640 | B1 | 1/2011 |
| WO | WO 2010092540 | A2 * | 8/2010 |

OTHER PUBLICATIONS

Office Action from the Taiwanese Patent Office dated Jul. 28, 2016.

* cited by examiner

PHOSPHOR DISPENSER

CROSS-REFERENCE TO RELATED APPLICATIONS

This application claims the benefit of Korean Patent Application No. 10-2012-0002467, filed on Jan. 9, 2012, in the Korean Intellectual Property Office, the disclosure of which is incorporated herein in its entirety by reference.

BACKGROUND

1. Field

The present disclosure relates to tappets and nozzles of phosphor dispensers for coating a phosphor liquid on a light-emitting device package.

2. Description of the Related Art

Light-emitting device chips, for example, light-emitting diodes (LEDs), are semiconductor devices that realize various light colors by configuring a light source having a PN junction of compound semiconductors. LEDs have a long lifetime, may be miniaturized and manufactured light, and may be driven at a low voltage due to a high directionality. Also, LEDs are strong against impact and vibration, do not require a preheating time and a complicated driving, and may be packaged in various types. Accordingly, LEDs may be applied for various purposes.

In order to realize a light-emitting device that emits white light, generally, a phosphor layer in which a yellow phosphor or a mixture of a green phosphor and a red phosphor is formed on a blue light-emitting diode. The phosphor layer is formed on a light-emitting device chip by coating a phosphor liquid, in which a phosphor is mixed with an epoxy resin or a silicon resin, using a phosphor dispenser. Through a drying process of the phosphor layer, a light-emitting device package is manufactured.

A phosphor dispenser includes a nozzle through which a phosphor liquid is ejected and a tappet that pushes the phosphor liquid towards the nozzle while the tappet is moving towards the nozzle.

A conventional tappet and nozzle are formed of materials having a high abrasion resistance, for example, tungsten carbide, or wear-resistant ceramics, for example, silicon nitride, silicon carbide, or zirconia.

However, the tappet and nozzle are worn out by the phosphor due to repeated and high-speed reciprocal movement of the tappet, and accordingly, it is difficult to eject a uniform quantity of a phosphor liquid and the life expectancy of the tappet and nozzle is shortened.

SUMMARY

Provided are phosphor dispensers that can improve wearing characteristics of a tappet and nozzle that are worn out by a phosphor of a phosphor liquid in an ejecting process.

Additional aspects will be set forth in part in the description which follows and, in part, will be apparent from the description, or may be learned by practice of the presented embodiments.

According to an aspect of the present disclosure, there is provided a phosphor dispenser that ejects a phosphor liquid, the phosphor dispenser including: a nozzle having a space for accommodating the phosphor liquid, wherein an opening for ejecting the phosphor liquid is connected to the space; and a tappet reciprocally movable with respect to the nozzle to eject the phosphor liquid in the space through the nozzle, wherein the tappet includes a cylindrical unit having a cylindrical shape and a convex unit having a hemispherical shape that is convex towards the nozzle from the cylindrical unit, and the convex unit includes polycrystalline diamond (POD).

The convex unit may include a plurality of diamond particles and a binder.

The plurality of diamond particles may have an average diameter approximately in a range from about 1 μm to about 1.7 μm.

An amount of the binder may approximately be in a range from about 8 wt. % to about 16 wt. % of the total weight including the plurality of diamond particles.

The phosphor dispenser may further include a binding layer between the convex unit and the cylindrical unit for bonding the convex unit and the cylindrical unit.

The cylindrical unit may include tungsten carbide or a wear-resistant ceramic.

At least a concave unit of the nozzle that corresponds to the convex unit and contacts the space may include PCD.

The convex unit and the cylindrical unit may be formed as one body, and only a surface of the convex unit may be coated with PCD.

According to another aspect of the present disclosure, there is provided a phosphor dispenser that ejects a phosphor liquid. The phosphor dispenser includes a nozzle having a space for accommodating the phosphor liquid, wherein an opening for ejecting the phosphor liquid is connected to the space; and a tappet reciprocally movable with respect to the nozzle to eject the phosphor liquid in the space of the nozzle through the nozzle, wherein the tappet includes a cylindrical unit having a cylindrical shape and a groove in a length direction thereof, and a convex unit having a hemispherical shape and including an extension unit extending to correspond to the groove in the cylindrical unit and to face the hemispherical shape, and the convex unit includes polycrystalline diamond (PCD).

According to another aspect of the present disclosure, there is provided a phosphor dispenser that includes a nozzle having a space for accommodating a phosphor liquid and an opening for ejecting the phosphor liquid; and a tappet reciprocally movable with respect to the nozzle to eject the phosphor liquid from the space through the opening, wherein said tappet includes polycrystalline diamond (PCD).

At least a portion of the tappet adjacent to the nozzle includes the polycrystalline diamond (PCD).

At least a portion of the nozzle adjacent to the tappet includes polycrystalline diamond (PCD).

The tappet may include a cylindrical unit having a cylindrical shape and a convex unit having a hemispherical shape that is convex towards the nozzle from the cylindrical unit, the at least a portion of the tappet may include the convex unit.

The cylindrical unit may include tungsten carbide or a wear-resistant ceramic.

The tappet may include a coating layer formed on a surface thereof, the at least a portion of the tappet may include the coating layer.

According to the present disclosure, the lifetimes of the tappet and the nozzle of the phosphor dispenser may be increased.

Also, it is possible to eject an accurate quantity of a phosphor liquid, and thus, a color distribution of a light-emitting device package may be improved. In particular, because the wear-resistance of the tappet and nozzle can be improved, phosphor particles having a relatively large diameter may be effectively ground, and thus, the color distribution of the light-emitting device package may further be improved.

BRIEF DESCRIPTION OF THE DRAWINGS

These and/or other aspects will become apparent and more readily appreciated from the following description of the embodiments, taken in conjunction with the accompanying drawings in which.

DETAILED DESCRIPTION

Figure 1:
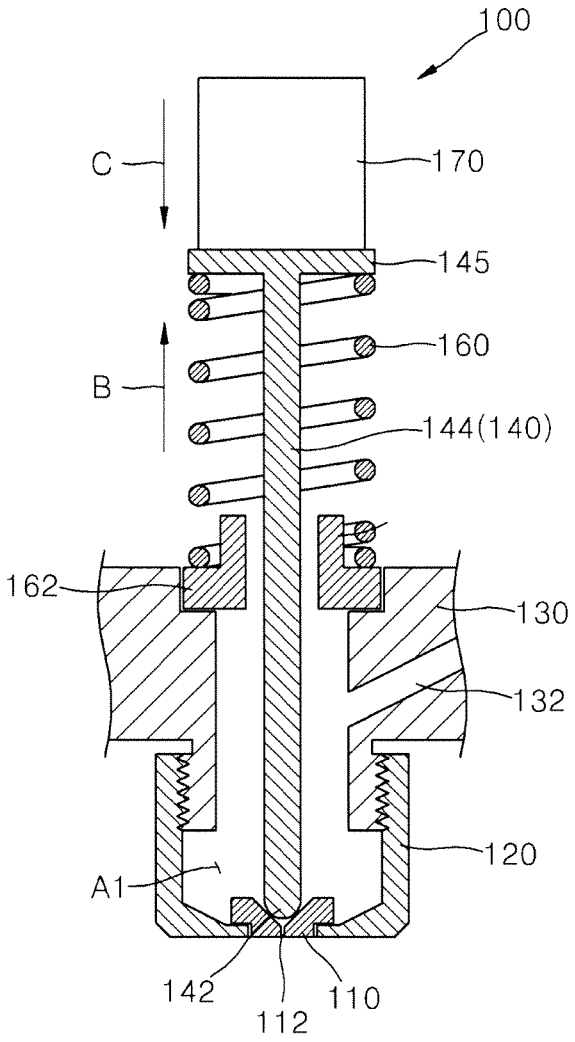
FIG. 1 is a schematic cross-sectional view illustrating a portion of a phosphor dispenser according to an embodiment of the present disclosure.

Reference will now be made in detail to embodiments, examples of which are illustrated in the accompanying drawings. In the drawings, like reference numerals refer to like elements throughout and the thicknesses or sizes of each constituent element are exaggerated for clarity. It will be understood that when an element or layer is referred to as being "on" another element or layer, the element or layer may be directly on another element or layer, or intervening elements or layers may also be present.

FIG. 1 is a schematic cross-sectional view illustrating a portion of a phosphor dispenser 100 according to an embodiment of the present disclosure.

Referring to FIG. 1, a nozzle 110 having an opening 112 in a central region thereof to eject a phosphor liquid is mounted and fixed on a nozzle holder 120. A nozzle holder fixing unit 130 is coupled to an inner circumferential surface of the nozzle holder 120. The nozzle holder 120 is fixed by the nozzle holder fixing unit 130. The nozzle holder 120 and the nozzle holder fixing unit 130 respectively have screw structures on surfaces where the nozzle holder 120 and the nozzle holder fixing unit 130 contact each other, and thus, the nozzle holder 120 and the nozzle holder fixing unit 130 may be combined by the screw structure. A phosphor liquid inlet 132 may be formed on a side of the nozzle holder fixing unit 130.

A tappet 140 includes a convex unit 142 that corresponds to a concave unit 114 (refer to FIG. 2) of the nozzle 110 and a cylindrical unit 144 that has a cylinder shape and is connected to the convex unit 142.

A first force to move the tappet 140 in a direction indicated by an arrow B (an upwards direction as viewed in FIG. 1) and a second force to move the tappet 140 in a direction indicated by an arrow C (a downwards direction as viewed in FIG. 1) are applied to the tappet 140. In FIG. 1, a compressive spring 160 is depicted as the first force applied to the tappet 140.

Referring to FIG. 1, a first fixing member 162 may be fixedly disposed on the nozzle holder fixing unit 130. A second fixing member 145 fixed on the tappet 140 is formed on an upper side of the tappet 140. The compressive spring 160 is wound on an outer circumference of the tappet 140 between the first fixing member 162 and the second fixing member 145, and thus, the tappet 140 is elastically biased in the direction indicated by the arrow B. A piezoactuator 170 is disposed on the second fixing member 145.

When a voltage is not applied to the piezoactuator 170, the tappet 140 receives a force in the direction indicated by the arrow B from the compressive spring 160. Accordingly, the convex unit 142 is separated from the nozzle 110. At this point, the opening 112 of the nozzle 110 is filled with a phosphor liquid supplied from a first region A1.

Next, when a voltage is applied to the piezoactuator 170, the tappet 140 moves in the direction indicated by the arrow C by a force of the piezoactuator 170, and thus, the convex unit 142 presses the nozzle 110. Accordingly, the phosphor liquid is ejected through the opening 112.

In FIG. 1, a force for moving the tappet 140 in a reciprocal movement is shown as an example. However, the present disclosure is not limited thereto. For example, the compressive spring 160 may be arranged and configured to bias downwards and the tappet 140 may be moved upwards by using the piezoactuator 170, detailed descriptions of which are omitted.

Figure 2:
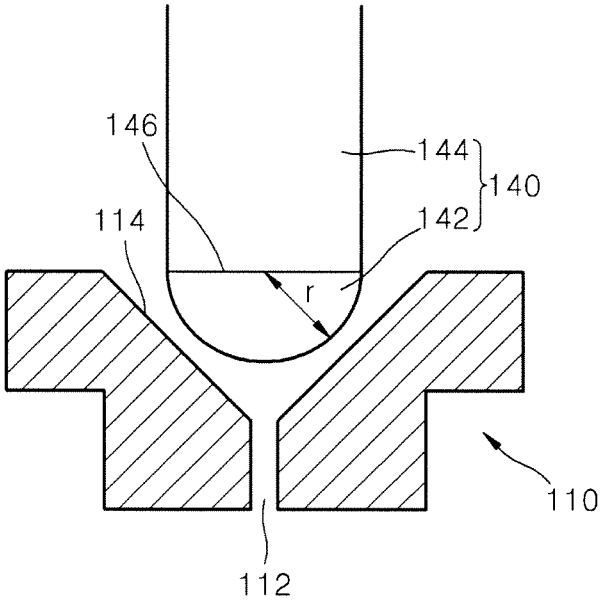
FIG. 2 is an enlarged cross-sectional view of a nozzle and a tappet of FIG. 1.

FIG. 2 is a phosphor liquid enlarged cross-sectional view of the nozzle 110 and the tappet 140 of FIG. 1. FIG. 2 shows a state before ejecting a phosphor liquid.

Referring to FIG. 2, a concave unit 114 of the nozzle 110 accommodates a phosphor liquid and provides a space that is connected to the opening 112 of the nozzle 110.

A portion of the tappet 140 where wearing occurs, due to a phosphor in the phosphor liquid when the tappet 140 reciprocally moves, is a surface of the convex unit 142. Also, a portion of the nozzle 110 where wearing mainly occurs due to friction with the phosphor liquid is the concave unit 114. The degree of wearing of the convex unit 142 may be seen from the reduction of a length of a radius of the convex unit 142, in particular, a radius "r" of a portion of the convex unit 142 that perpendicularly contacts the surface of the concave unit 114.

The tappet 140 according to the current exemplary embodiment includes the cylindrical unit 144 having a cylindrical shape and the convex unit 142 that convexly protrudes towards the nozzle 110 from the cylindrical unit 144. The convex unit 142 may have a hemispherical shape.

The cylindrical unit 144 may be formed of tungsten carbide.

The convex unit 142 may be formed of polycrystalline diamond (PCD). The PCD is manufactured by sintering a mold after forming the mold by combining diamond particles with a binder. The diamond particles may have an average diameter approximately in a range from about 1 μm to about 1.7 μm, and may have a size in a range from about 0.7 μm to about 2 μm.

In order to mold diamond particles, a binder is used. The binder bonds the diamond particles together by being interposed therebetween. The binder may be one selected from the group consisting of cobalt, chrome, nickel, manganese, tantalum, iron, and titanium carbide, or a mixture of these materials.

Figure 3:
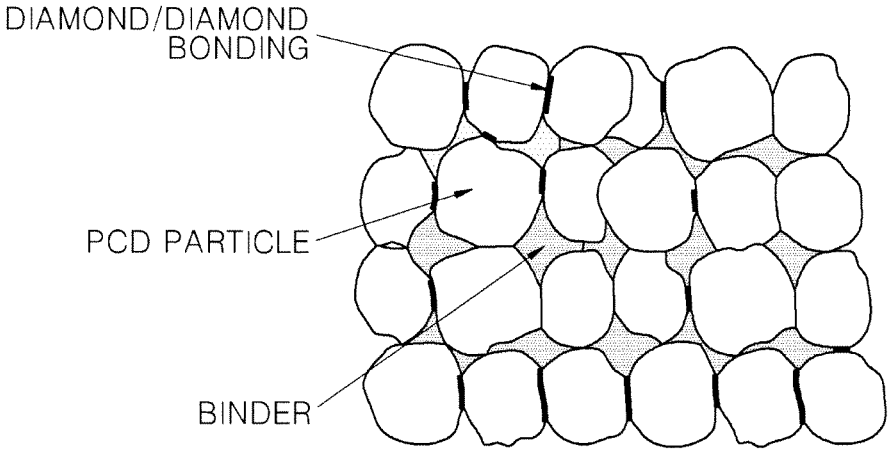
FIG. 3 is an exemplary schematic drawing showing the formation of polycrystalline diamond (PCD) by sintering diamond particles with a binder after distributing the binder among the diamond particles.

FIG. 3 is an exemplary schematic drawing showing the formation of PCD by sintering diamond particles with a binder after distributing the binder among the diamond particles. Referring to FIG. 3, the diamond particles are bonded by the binder, and also, the bonding may also occur directly between the diamond particles.

If the diamond particles have an average diameter greater than 2 μm, then the binder having a relatively low hardness may be worn by phosphor particles having a diameter approximately in a range from about 2 μm to about 16 μm. When this wearing due to the diamond particles having an average diameter greater than 2 μm occurs, the bonding between the diamond particles can be broken, and thus, a portion of the convex unit 142 of the tappet 140 may be broken.

The amount of the binder may vary according to the diameter of the diamond particles. The amount of the binder may approximately be in a range from about 8 wt. % to about 16 wt. % of the total weight including the diamond particles.

In order to bond the convex unit 142 formed of PCD to the cylindrical unit 144, a binder 146 is applied between the convex unit 142 and the cylindrical unit 144. The binder 146 may be referred to as a binding layer. Afterwards, the convex unit 142 and the cylindrical unit 144 are bonded by melting the binder 146 at a temperature of 1,400° C. through electrical welding under a high pressure of, for example, 80,000 bar. The binder 146 may be cobalt or the binder materials described above.

The wear-resistance of the tappet 140 is improved since the convex unit 142 of the tappet 140 includes PCD. However, when the nozzle 110 is made of a conventional hard metal or a wear-resistant ceramic, the wear-resistance of the nozzle 110 may not be relatively improved. Accordingly, the ejection of a uniform quantity of a phosphor liquid becomes difficult and the lifetime of the nozzle 110 may be reduced. In order to enable preventing these problems, like the convex unit 142 of the tappet 140, the nozzle 110 may also be formed of PCD. At this point, when the nozzle 110 includes PCD, the particle size of the diamonds and the amount and kind of binder are substantially the same as those of the convex unit 142, and thus, detailed descriptions thereof are omitted.

The convex unit 142 and the nozzle 110 may be formed of a single diamond.

Figure 4:
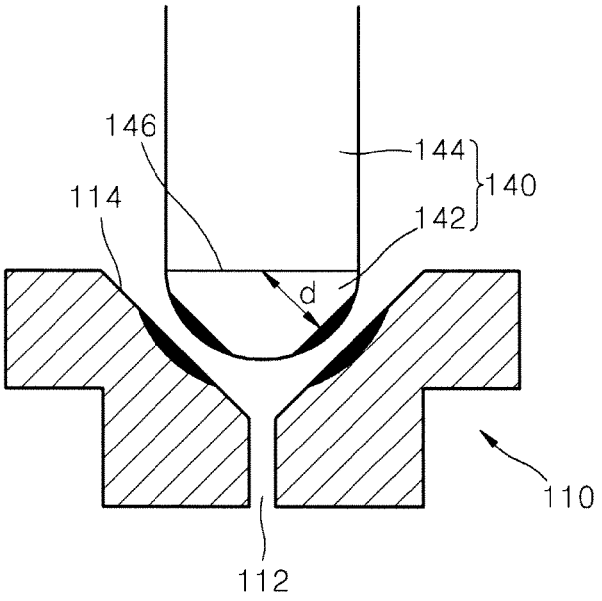
FIG. 4 is a cross-sectional view showing regions where wearing mainly occurs in a structure using conventional materials.

FIG. 4 is a cross-sectional view showing regions where wearing mainly occurs in a structure using conventional materials.

Referring to FIG. 4, when the tappet 140 is formed of tungsten carbide or a wear-resistant ceramic such as zirconia, and the nozzle 110 is formed of tungsten carbide, regions where wearing mainly occurs are the regions where the concave unit 114 of the nozzle 110 and the convex unit 142 meet each other. In FIG. 4, these regions are colored in black. A distance "d" indicates a length of a remaining portion of the region in the convex unit 142 where severe wearing occurs.

Figure 5:
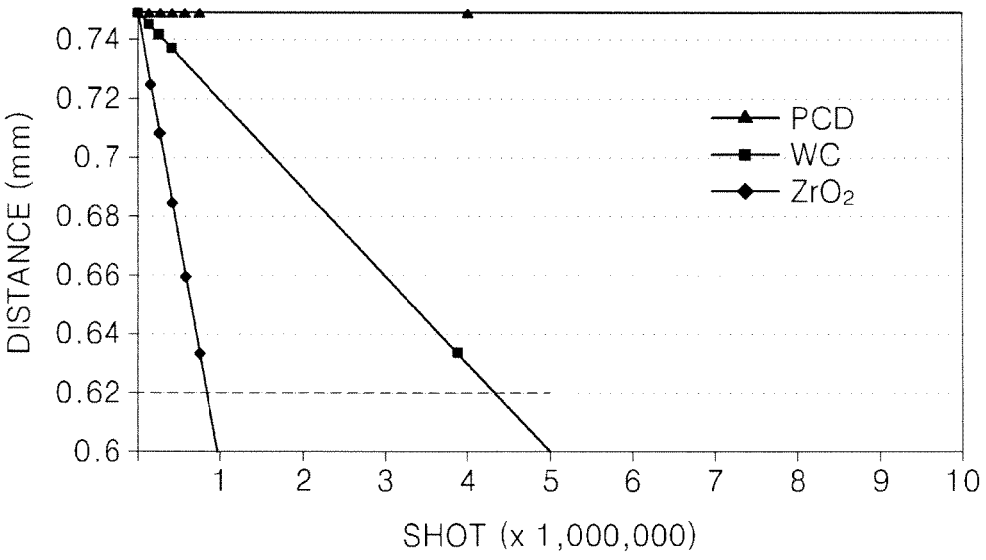
FIG. 5 is a graph showing the results of durability tests when a nozzle is formed of tungsten carbide and a convex unit of the tappet is formed of zirconia and tungsten carbide respectively in a conventional method; and when the tappet is formed of PCD according to an exemplary embodiment of the present disclosure.

FIG. 5 is a graph showing the results of durability tests when the nozzle 110 is formed of tungsten carbide and the convex unit 142 is formed of zirconia and tungsten carbide in a conventional method; and when the tappet 140 is formed of PCD according to an exemplary embodiment of the present disclosure.

In FIG. 5, a horizontal axis represents reciprocal shots of the tappet 140 and a vertical axis represents distances ("d" of FIG. 4) at a point of the convex unit 142 that contacts the concave unit 114 of the nozzle 110 (refer to FIG. 4) and where severe wearing occurs.

Referring to FIG. 5, when the distance "d" is 0.62 mm or less, the tappet 140 needs to be replaced due to a reduced ejection force. In the case of a conventional tappet formed of zirconia, a severe wearing occurs before 1 million shots; and in the case of a conventional tappet formed of tungsten carbide, the tappet reaches the end of its lifetime before 4.3 million shots due to severe wearing. However, in the case of the tappet 140 formed of PCD according to the current exemplary embodiment of the present disclosure, almost no wearing occurs even at 10 million shots.

In the current embodiment, the convex unit 142 and the nozzle 110 are formed of PCD. However, the present disclosure is not limited thereto. For example, the convex unit 142 may be formed such that a basic material of the convex unit 142 includes a hard material such as tungsten carbide, or a wear-resistant material such as zirconia, silicon carbide, or silicon nitride; and a PCD coating may be formed on a surface of the convex unit 142. The PCD coating can be a mixture of a binder and diamond particles.

When a PCD coating is formed on the surface of the convex unit 142, main bodies of the cylindrical unit 144 and the convex unit 142 may be formed as one body.

Like the convex unit 142, the nozzle 110 may also be formed such that a basic material of the nozzle 110 is a hard material such as tungsten carbide or a wear-resistant material such as zirconia, silicon carbide, or silicon nitride; and a PCD coating may be formed on a surface of the concave unit 114 of the nozzle 110.

Figure 6:
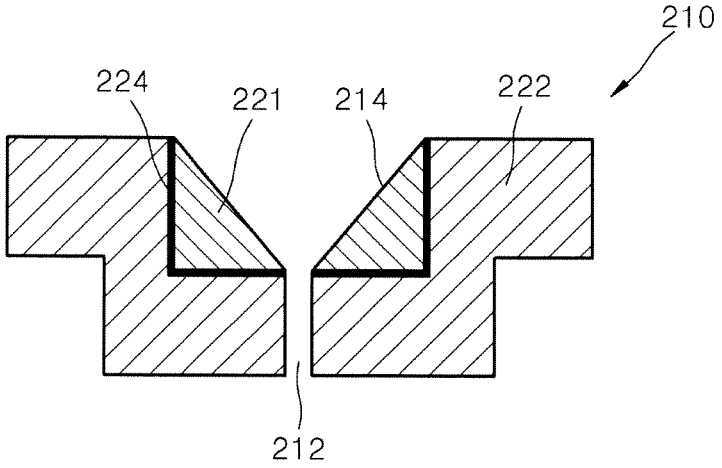
FIG. 6 is a cross-sectional view of a nozzle according to another embodiment of the present disclosure.

FIG. 6 is a cross-sectional view of a nozzle 210 according to another embodiment of the present disclosure.

Referring to FIG. 6, a concave unit 214 of the nozzle 210 provides a space that accommodates a phosphor liquid and is connected to an opening 212. Only a first portion 221, which is mainly worn by the phosphor liquid, may be formed of PCD and a second portion 222, which is a remaining portion of the nozzle 210, may be formed of a hard material. The first portion 221 and the second portion 222 may be bonded by a binder 224 using an electrical welding method as described above, and thus, detailed descriptions thereof are omitted.

Figure 7:
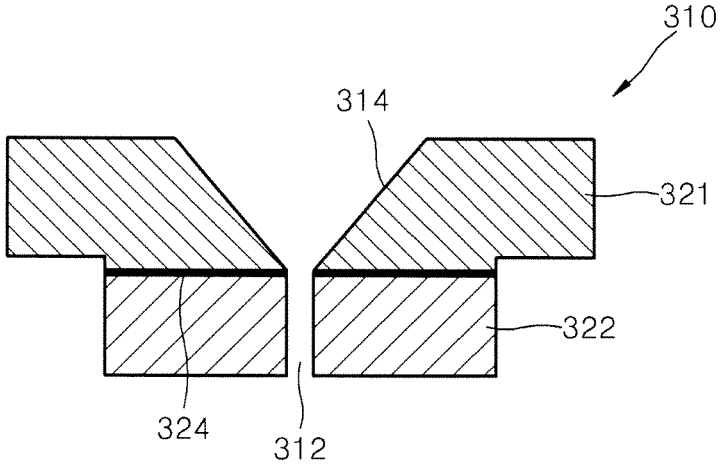
FIG. 7 is a cross-sectional view of a nozzle according to another embodiment of the present disclosure.

FIG. 7 is a cross-sectional view of a nozzle 310 according to another embodiment of the present disclosure.

Referring to FIG. 7, the nozzle 310 includes a first part 321 surrounding a concave unit 314 and a second part 322 surrounding an opening 312. The concave unit 314 of the nozzle 310 provides a space that accommodates a phosphor liquid and is connected to the opening 312. The first part 321 is bonded onto the second part 322 by using a binder 324. Only the first part 321 including the concave unit 314, that is mainly worn by a phosphor liquid, is formed of PCD, and the second part 322 may be formed of a hard material.

Figure 8:
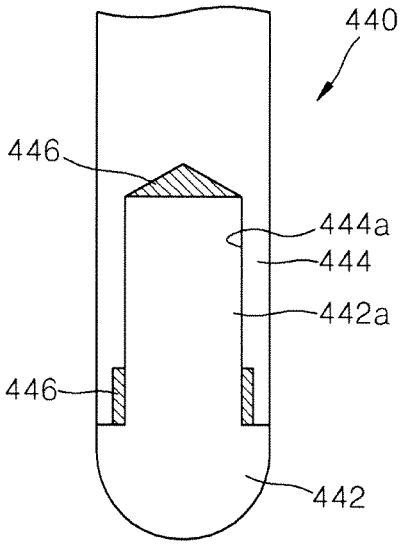
FIG. 8 is a schematic cross-sectional view of a portion of a tappet of a phosphor dispenser according to another embodiment of the present disclosure.

FIG. 8 is a schematic cross-sectional view of a portion of a tappet 440 of a phosphor dispenser according to another embodiment of the present disclosure. Like reference numerals are used to indicate elements that are substantially identical to the elements of previous embodiments, and thus detailed descriptions thereof will not be repeated.

Referring to FIG. 8, the tappet 440 includes a convex unit 442 formed to correspond to, for example, the concave unit 114 of the nozzle 110 (refer to FIG. 2) and a cylindrical unit 444 that has a cylindrical shape and is connected to the convex unit 442. A groove **444*a* is formed on a surface of the cylindrical unit 444 facing the convex unit 442 in a length direction of the tappet 440. An extension unit 442***a* extending from the convex unit 442 is formed to correspond to the groove 444*a* in the cylindrical unit 444.

The cylindrical unit 444 may be formed of tungsten carbide. The convex unit 442 may be formed of PCD. PCD is formed by sintering at a high temperature under a high pressure after forming a mold by mixing a binder and diamond particles. The diamond particles may have an average diameter approximately in a range from about 1 μm to about 1.7 μm, and may have a size in a range from about 0.7 μm to about 2 μm.

When the convex unit 442 is formed using PCD, after forming a mold by mixing diamond particles and a binder, the mold is sintered. The binder bonds the diamond particles together by being interposed therebetween. The binder may be cobalt or a binder material described above.

In order to bond the cylindrical unit 444 to the convex unit 442, a binder 446 is introduced between the cylindrical unit 444 and the convex unit 442. Afterwards, the convex unit 442 and the cylindrical unit 444 may be bonded by melting the binder 446 at a temperature of 1,400° C. through electrical welding under a high pressure of, for example, 80,000 bar. In FIG. 8, the binder 446 is a sintered binder.

In FIG. 8, the main body of the convex unit 442 can be formed of PCD. However, the present disclosure is not limited thereto. For example, a basic material of the convex unit 442 may be a hard material such as tungsten carbide or a wear-resistant material such as zirconia, silicon carbide, or silicon nitride; and a PCD coating may be formed on a surface of the convex unit 442.

While this disclosure has been particularly shown and described with reference to exemplary embodiments thereof, it will be understood by those of ordinary skill in the art that various changes in form and details may be made therein without departing from the spirit and scope of the disclosure as defined by the appended claims.

What is claimed is:

1. A phosphor dispenser that ejects a phosphor liquid, the phosphor dispenser comprising:

a nozzle having a space defined by a nozzle holder and a nozzle holder fixing unit coupled to an inner circumferential surface of the nozzle holder for accommodating the phosphor liquid, wherein an opening in the nozzle holder for ejecting the phosphor liquid supplied through a phosphor liquid inlet formed on a lateral side of the nozzle holder fixing unit, is connected to the space; and a tappet reciprocally movable with respect to the nozzle to eject the phosphor liquid in the space through the nozzle, wherein the tappet comprises a cylindrical unit having a cylindrical shape and a convex unit having a hemispherical shape that is convex towards the nozzle from the cylindrical unit, the convex unit includes polycrystalline diamond (PCD) including a plurality of diamond particles and a binder, the cylindrical unit includes no polycrystalline diamond (PCD), and the space is exposed to the outside of the phosphor dispenser through an opening, which the cylindrical unit penetrates through, on a top side of the nozzle holder fixing unit facing the nozzle.

2. The phosphor dispenser of claim 1, wherein the diamond particles have an average diameter approximately in a range from about 1 μm to about 1.7 μm.

3. The phosphor dispenser of claim 1, wherein an amount of the binder is approximately in a range from about 8 wt. % to about 16 wt. % of the total weight including the plurality of diamond particles.

4. The phosphor dispenser of claim 1, further comprising a binding layer between the convex unit and the cylindrical unit for bonding the convex unit and the cylindrical unit.

5. The phosphor dispenser of claim 1, wherein the cylindrical unit includes tungsten carbide or a wear-resistant ceramic.

6. The phosphor dispenser of claim 1, wherein at least a concave unit of the nozzle that corresponds to the convex unit and contacts the space includes PCD.

7. The phosphor dispenser of claim 1, wherein the convex unit and the cylindrical unit are formed as one body, and a surface of the convex unit is coated with PCD.

8. A phosphor dispenser that ejects a phosphor liquid, the phosphor dispenser comprising:

a nozzle having a space defined by a nozzle holder and a nozzle holder fixing unit coupled to, an inner circumferential surface of the nozzle holder for accommodating the phosphor liquid, wherein an opening in the nozzle holder for ejecting the phosphor liquid supplied through a phosphor liquid inlet formed on a lateral side of the nozzle holder fixing unit, is connected to the space; and a tappet reciprocally movable with respect to the nozzle to eject the phosphor liquid in the space through the nozzle, wherein the tappet comprises a cylindrical unit having a cylindrical shape and a groove in a longitudinal direction thereof, and a convex unit having a hemispherical shape and comprising an extension unit extending to correspond to the groove in the cylindrical unit and to face the hemispherical shape, the convex unit includes polycrystalline diamond (PCD) including a plurality of diamond particles and a binder, the cylindrical unit includes tungsten carbide or a wear-resistant ceramic and includes no polycrystalline diamond (PCD), and the space is exposed to the outside of the phosphor dispenser through an opening, which the cylindrical unit penetrates through, on a top side of the nozzle holder fixing unit facing the nozzle.

9. The phosphor dispenser of claim 8, wherein the plurality of diamond particles have an average diameter approximately in a range from about 1 μm to about 1.7 μm.

10. The phosphor dispenser of claim 8, wherein an amount of the binder is approximately in a range from about 8 wt. % to about 16 wt. % of the total weight including the plurality of diamond particles.

11. The phosphor dispenser of claim 8, further comprising a binding layer between the convex unit and the cylindrical unit for bonding the convex unit and the cylindrical unit.

12. The phosphor dispenser of claim 8, wherein at least a concave unit of the nozzle that corresponds to the convex unit and contacts the space includes PCD.

13. A phosphor dispenser comprising:

a nozzle having a space defined by a nozzle holder and a nozzle holder fixing unit coupled to an inner circumferential surface of the nozzle holder for accommodating a phosphor liquid and an opening in the nozzle holder for ejecting the phosphor liquid supplied through a phosphor liquid inlet on a lateral side of the nozzle holder fixing unit; and a tappet reciprocally movable with respect to the nozzle to eject the phosphor liquid from the space through the opening, wherein the tappet includes polycrystalline diamond (PCD) including a plurality of diamond particles having an average diameter approximately in a range from about 1 μm to about 1.7 μm and a binder, and the space is exposed to the outside of the phosphor dispenser through an opening on a top side of the nozzle holder fixing facing the nozzle unit.

14. The phosphor dispenser of claim 13, wherein at least a portion of the tappet adjacent to the nozzle includes the polycrystalline diamond (PCD).

15. The phosphor dispenser of claim 14, wherein at least a portion of the nozzle adjacent to the tappet includes polycrystalline diamond (PCD).

16. The phosphor dispenser of claim 14, wherein the tappet comprises a cylindrical unit having a cylindrical shape and a convex unit having a hemispherical shape that is convex towards the nozzle from the cylindrical unit, said at least a portion of the tappet includes the convex unit.

17. The phosphor dispenser of claim 16, wherein the cylindrical unit includes tungsten carbide or a wear-resistant ceramic.

18. The phosphor dispenser of claim 14, wherein the tappet comprises a coating layer formed on a surface thereof, said at least a portion of the tappet includes the coating layer.

19. The phosphor dispenser of claim 16, further comprising a binding layer between the convex unit and the cylindrical unit for bonding the convex unit and the cylindrical unit.

20. The phosphor dispenser of claim 16, wherein the cylindrical unit includes no polycrystalline diamond (PCD).

* * * * *